US008723630B2

(12) United States Patent
Hu et al.

(10) Patent No.: US 8,723,630 B2
(45) Date of Patent: May 13, 2014

(54) CURRENT TRANSFORMER FOR SUPPLYING POWER TO ELECTRONIC CONTROLLER

(75) Inventors: Yinglong Hu, Shanghai (CN); Zeliang Xu, Shanghai (CN)

(73) Assignee: Noark Electric (Shanghai) Co. Ltd. (CN)

( * ) Notice: Subject to any disclaimer, the term of this patent is extended or adjusted under 35 U.S.C. 154(b) by 0 days.

(21) Appl. No.: 13/978,289

(22) PCT Filed: Sep. 15, 2011

(86) PCT No.: PCT/CN2011/079658

§ 371 (c)(1),
(2), (4) Date: Jul. 3, 2013

(87) PCT Pub. No.: WO2012/094903

PCT Pub. Date: Jul. 19, 2012

(65) Prior Publication Data

US 2013/0285786 A1 Oct. 31, 2013

(30) Foreign Application Priority Data

Jan. 13, 2011 (CN) ..... 2011 1 0006789

(51) Int. Cl.
*H01F 17/06* (2006.01)
*H01F 38/20* (2006.01)
*H01F 27/24* (2006.01)

(52) U.S. Cl.
USPC ..... 336/175; 336/173; 336/178; 336/212

(58) Field of Classification Search
USPC ..... 336/173, 175, 178, 212
See application file for complete search history.

(56) References Cited

U.S. PATENT DOCUMENTS 1,862,613 A * 6/1932 Tomoda ..... 336/66
3,546,565 A * 12/1970 Koll et al. ..... 323/309
4,746,891 A * 5/1988 Zylstra ..... 336/171
5,726,846 A 3/1998 Houbre
7,002,440 B2 * 2/2006 Attarian et al. ..... 335/18
7,057,485 B2 * 6/2006 Preusse et al. ..... 336/173
7,561,387 B2 * 7/2009 Miller et al. ..... 361/35

FOREIGN PATENT DOCUMENTS

CN 1129347 8/1996
CN 101685725 3/2010

(Continued)

OTHER PUBLICATIONS

International Search Report dated Dec. 8, 2011 issued in corresponding International patent application No. PCT/CN2011/079658.

*Primary Examiner* — Tsz Chan

(74) *Attorney, Agent, or Firm* — Ostrolenk Faber LLP

(57) ABSTRACT

A current transformer supplying a power for an electronic controller comprises two independent core magnetic circuits, wherein a first core magnetic circuit is a closed loop formed by connecting a U-shaped core and a linear core, a primary conductor extends through the closed loop, and a secondary winding for power supply is wound on the linear core; a second core magnetic circuit having an opening shape is disposed in parallel to the linear core of the first core magnetic circuit, and the open end of the second core magnetic circuit is coupled to the first core magnetic circuit through air gaps. The area of the cross section of the linear core is less than that of the cross section of the U-shaped core, so that the linear core can be magnetically saturated earlier than the U-shaped core. The centerline length of the U-shaped core is 1.5 to 4 times of that of the linear core. The current transformer of the present invention can not only normally start and work in case that a primary current is far lower than a rated current In, but also achieve the purpose of inhibiting rapid increase of an output current of the secondary windings and smoothing the output current in case that the primary current is far more than the rated current In.

9 Claims, 3 Drawing Sheets

(56) References Cited

FOREIGN PATENT DOCUMENTS

| | | | |
|---|---|---|---|
| CN | 101908413 | | 12/2010 |
| CN | 102136358 | | 7/2011 |
| CN | 201975250 | | 9/2011 |
| EP | 0 561 717 | A1 | 9/1993 |
| JP | 2004-103791 | | 4/2004 |
| WO | WO 2009/103102 | A1 | 8/2009 |

* cited by examiner

CURRENT TRANSFORMER FOR SUPPLYING POWER TO ELECTRONIC CONTROLLER

CROSS REFERENCE TO RELATED APPLICATIONS

The present application is a 35 U.S.C. §371 National Phase conversion of PCT/CN2011/079658, filed Sep. 15, 2011, which claims benefit of Chinese Application No. 2011 10006789.8, filed Jan. 13, 2011, the disclosure of which is incorporated herein by reference. The PCT International Application was published in the Chinese language.

TECHNICAL FIELD

The present invention relates to current transformers for power supply for the electronic controller, more particularly to current transformer for supplying power to the electronic trip unit (ETU) of low-voltage circuit breaker.

BACKGROUND OF THE INVENTION

The electronic control device of low-voltage circuit breaker, such as electronic tripping unit, needs to be supplied with power, a built-in current transformer of a circuit breaker is generally utilized to obtain power from a primary main loop, electric power originates from a current flowing through a primary core-extending conductor, and an induced current in a secondary winding of the current transformer is supplied to electronic tripping unit for its operation.

At present, stronger functions of the electronic controller for low-voltage circuit breaker leads to larger power consumption of the electronic controller. Meanwhile, Perfection for protective function requires a lower protection starting point of the electronic controller. According to the national standard GB/T22710-2008 Electronic Controller for Low-Voltage Circuit Breaker in our country brought into effect on Oct. 1, 2009, a controller can work reliably and must implement the fundamental protective function when all phase currents in a main circuit are not less than 0.4 In (In is rated current) in the case of no auxiliary power source. According to the American national standard ANSI Std. C37.17-1997, however, a controller must complete the function of overload protection and ground fault protection in the case of no external auxiliary power source. As for the function of ground protection, the setting value of a protective current is 0.2 In to 1 In, that is, a transformer for supplying power to a controller has a secondary output so large that the controller works reliably and must implement the function of ground protection when a three-phase current of the primary main circuit is required to be minimally set to 0.2 In or single-phase 0.4 In. Therefore, the supply current transformer for an electronic controller has to be designed to satisfy the above operation conditions of controller. In other words, on the one hand, smaller primary current leads to wider range in which a controller can give its protection, and on the other hand, in case that the primary current is small enough as described above, the transformer is required to output a secondary current that is large enough.

Simultaneously, it is well known that a current transformer for power supply is typically a current transformer with cores. Input and output of such an core transformer are substantially linear within a particular range, and its secondary current varies based on variation of primary current. When a primary current reaches a normal starting current of the current transformer, the current transformer generates power sufficient to maintain reliable working of the controller, that is to say, the controller has a certain power consumption, and when the primary current increases once again, the current transformer for supplying power to an electronic controller generates power that significantly exceeds the power required for normal working of the electronic controller, in this case, excessive energy needs to be consumed in other ways, which undoubtedly requires an additional power consumption device. Hence, it is another major contradiction for such current transformers (typically known as self-regenerated power sources) to determine the way of acquiring a secondary current output, which is as steady as possible, instead of ceaseless increase, within an extremely wide primary current range from normal state to non-normal state after the secondary output of the current transformer meets the working demand of the controller. An ideal scheme for simultaneously solving the contradiction between the two aspects above has not been found yet for a long time. The difficulty falls not only upon the problem of structural scheme, but also upon the problem of optimization and matching for structural parameters.

Some structural design schemes for the magnetic shunt of current transformer has been worked out on the basis of electromagnetic principle, and these schemes featured by main magnetic circuit, auxiliary magnetic circuit and air gaps are approximately classified in two types below. One is as illustrated in U.S. Pat. No. 5,726,846A and CN 200110176191 in which a main magnetic circuit and an auxiliary magnetic circuit are not two independent magnetic circuits and air gaps are disposed in the auxiliary magnetic circuit, and what differs CN 200110176191 from U.S. Pat. No. 5,726,846A is that, the thickness of the air gaps in the former is variable, whereas the thickness of the air gaps in the latter is invariable. The other one is as illustrated in CN1637968.B in which a first magnetic circuit and a second magnetic circuit are two independent magnetic circuits each forming a closed loop, and the first magnetic circuit is operatively connected with the second magnetic circuit so that a certain proportion of main magnetic flux is absorbed by the second magnetic circuit before the main magnetic flux of the first magnetic circuit gets through the core of a secondary winding. The common defect in the prior arts above consists in an incapability of meeting two use demands simultaneously: 1. in the case that the primary current is 0.2 In to be small enough, the demand on normal start and work of the controller has to be met; and 2, in the case that the primary current is more than 1 In to be large enough (especially when the primary current is an overload current or a short circuit current), output of the secondary current can still be maintained under a stable state and normal work of the controller can be ensured. In the prior arts above, due to a plurality of factors like parameter matching, variation precision of variable air gaps, response speed and the like, the scheme featured by variable air gaps, though possibly advantageous for solving the above problems in terms of principle, is still a design under the state that is idealized, but fails to reach the ideal effect, and, instead, leads to new problems like complex structure, difficult assembly and debugging, etc.

SUMMARY OF THE INVENTION

An objective of the present invention is to overcome the shortcomings in the prior arts above and to provide a supply current transformer for an electronic controller, which can not only maintain stable output of a secondary current when a primary current of a main circuit increases and exceeds a rated current 1.0 In, but also lower the temperature of cores when the primary current is turned into an overload current or a short circuit current, thus improving the service life as well as safety and reliability of product.

Another objective of the present invention is to provide a supply current transformer for an electronic controller, which, when a primary current of a main circuit is not less than 0.2 In, outputs a secondary current that can meet the demand on normal work of the electronic controller.

To achieve the objectives above, the following technical scheme is adopted in the present invention.

A supply current transformer for an electronic controller comprises a first core magnetic circuit 11 and a second core magnetic circuit 41 independent of each other, the first core magnetic circuit 11 is a closed loop formed by connecting a U-shaped core 12 and a linear core 13, and a primary core-extending conductor 21 extends through the closed loop of the first core magnetic circuit 11, and a secondary winding 31 for power supply is wound on the linear core 13 of the first core magnetic circuit 11; a second core magnetic circuit 41 having an opening shape is disposed in parallel to the linear core 13 of the first core magnetic circuit 11, and an open end of the second core magnetic circuit 41 is coupled to the first core magnetic circuit 11 through air gaps 71, 72. The area of the cross section of the linear core 13 is less than that of the cross section of the U-shaped core 12, so that the linear core 13 can be magnetically saturated earlier than the U-shaped core 12.

According to the preferred embodiment of the present invention, the area of the cross section of the U-shaped core 12 is 1.2 to 3 times of that of the cross section of the linear core 13. The centerline length of the U-shaped core 12 is 1.5 to 4 times of that of the linear core 13, preferably, the U-shaped core 12 and the linear core 13 of the first core magnetic circuit 11 have a spacing of 2-3 mm from the primary core-extending conductor 21 surrounded by the first core magnetic circuit, so that excellent electrical isolation is formed between the first core magnetic circuit 11 and the primary conductor 21 surrounded by the first core magnetic circuit, and simultaneously, the first core magnetic circuit 11 surrounding the primary conductor 21 has the shortest length. When the linear core 13 is just magnetically saturated, a corresponding primary current $I_1$ is 0.8 to 1.2 times of a rated current In of a primary main circuit. The second core magnetic circuit 41 and the first core magnetic circuit 11 are disposed in a coplanar manner, so that magnetic flux flowing between the first core magnetic circuit 11 and the second core magnetic circuit 41 is maintained in the original direction. In addition, the area of the cross section of the core of the second core magnetic circuit 41 is equal to that of the cross section of the U-shaped core 12 of the first core magnetic circuit 11.

Two air gaps 71, 72 between the open end of the second core magnetic circuit 41 and the first core magnetic circuit 11 are fixed air gaps, which are respectively located at the two intersections of the linear core 13 and the U-shaped core 12 and also located at the two sides of the secondary winding 31 for power supply. The two fixed air gaps 71, 72 have a thickness from 0.1 mm to 2 mm. The two fixed air gaps 71, 72 are equivalent in thickness and respectively filled with solid non-ferromagnetic matters.

Another supply current transformer for an electronic controller according to the present invention comprises a first core magnetic circuit 11 and a second core magnetic circuit 41, the first core magnetic circuit 11 is a closed loop formed by connecting a U-shaped core 12 and a linear core 13, and a primary core-extending conductor 21 extends through the closed loop, and a secondary winding 31 for power supply is wound on the linear core 13; a second core magnetic circuit 41 having an opening shape is disposed in parallel to the linear core 13, and an open end of the second core magnetic circuit 41 is coupled to the first core magnetic circuit 11 through an air gap 71. The area of the cross section of the linear core 13 is less than that of the cross section of the U-shaped core 12, so that the linear core 13 can be magnetically saturated earlier than the U-shaped core 12. The centerline length of the U-shaped core 12 is 1.5 to 4 times of that of the linear core 13, so that excellent electrical isolation is formed between the first core magnetic circuit 11 and the primary conductor 21 surrounded by the first core magnetic circuit, and simultaneously, the first core magnetic circuit 11 surrounding the primary conductor 21 has the shortest length. The open end of the second core magnetic circuit 41 is connected in parallel with the intersection of the linear core 13, located at one side of the secondary winding 31 for power supply, and the U-shaped core 12, and the other end of the second core magnetic circuit 41 is coupled, through the fixed air gap 71, to the intersection of the linear core 13, located at the other side of the secondary winding 31 for power supply, and the U-shaped core 12.

The current transformer of the present invention for power supply is designed based on the magnitude of the primary current, and main magnetic flux is realized through the shunt portion of the second magnetic circuit after the primary current extending through the transformer increases, thus achieving the purpose of smoothing the output curve of a secondary winding current for power supply. Furthermore, the main magnetic circuit of the present invention is designed to be much shorter than that in the prior art and shorter magnetic circuit means smaller magnetic resistance, so the present invention can obtain larger output of the secondary winding current for power supply under smaller primary current, in order to satisfy normal working of the electronic controller. The principle of a 1600 A transformer model constructed according to the present invention has been verified by electromagnetic field simulation, and the simulation result shows that: in case that the primary current is small enough, the secondary current output by the model of the present invention can enable an electronic tripping unit to acquire much wider protection range than the prior art, and in case that there is no auxiliary power source, the secondary winding for power supply outputs 100 mA that has already reached the starting work point of the electronic controller, when all phase currents of the primary main circuit are not less than 0.4 In or a three-phase current is not less than 0.2 In, i.e. 320 A. In addition, when the primary current reaches 5 In, i.e. about 8000 A, the secondary winding for power supply outputs 500 mA to obtain significant restriction effect on the output of the secondary winding for power supply. This proves that the device of the present invention has better capability of power supply output, improves the integral performances of the current transformer in power supply output, and ensures normal work of the electronic controller without an additional power consumption device.

DESCRIPTION OF THE PREFERRED EMBODIMENT

Figure 1:
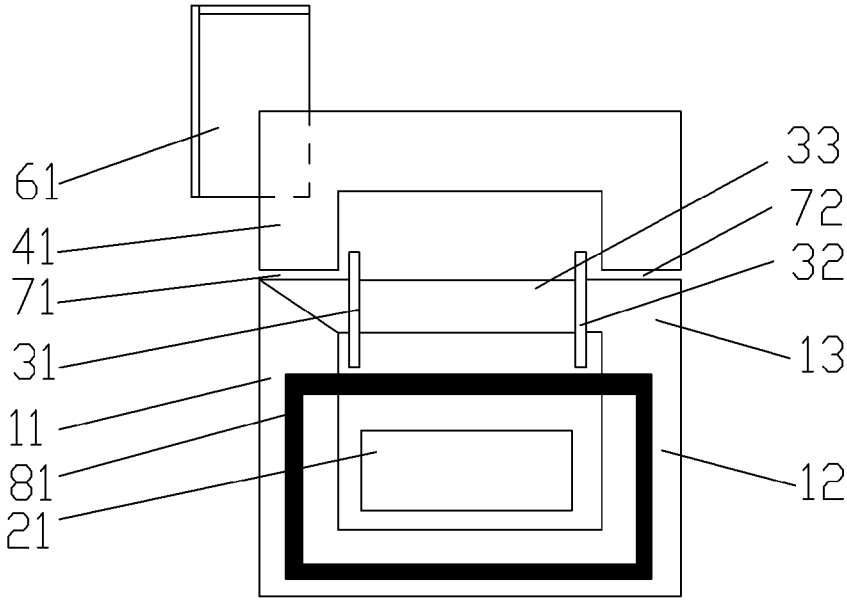
FIG. 1 is a structural schematic diagram of the first embodiment of the current transformer of the present invention for supplying power to electronic controller.

FIG. 1 is the first embodiment of the current transformer of the present invention for supplying power to electronic controller. As shown in FIG. 1, the current transformer of the present invention for supplying power to electronic controller comprises a closed-loop-shaped and independent first core magnetic circuit 11, a U-shaped and independent second core magnetic circuit 41 and a secondary winding 31 for power supply wound on the first core magnetic circuit 11. In the embodiment as shown in FIG. 1, a reference numeral 12 represents a well-punched U-shaped core, 13 is a 'linear' core, the first core magnetic circuit is formed by connecting the U-shaped core 12 and the linear core 13, and the U-shaped core 12 and the linear core 13 are integrated by means of such connection. The supply current transformer of the present invention is fixed and encapsulated by a plastic casing on which a through groove for a primary core-extending conductor 21 to extend through is arranged, and the through groove is in tight fit with the primary core-extending conductor 21 extending therethrough, the first core magnetic circuit 11 is wound outside the primary core-extending conductor 21, allowing the primary core-extending conductor 21 to extend through the closed loop of the first core magnetic circuit 11 that surrounds the primary core-extending conductor 21, and the primary core-extending conductor 21 forms a primary winding of the first core magnetic circuit 11. The secondary winding 31 for power supply is composed of an enameled wire pack 33 wound on a winding skeleton 32 and is wound on the portion of the linear core 13 of the first core magnetic circuit 11, and such winding is completed prior to the connection between the linear core 13 and the U-shaped core 12. U-shaped and linear punching sheets are riveted in a laminated manner or firmly welded respectively at first, the winding 31 is then properly assembled, afterwards, the both are spliced to form a closed shape that surrounds the primary core-extending conductor 21, firm welding is performed at seams to form the independent first core magnetic circuit 11, and the transformer is located and encapsulated by the plastic casing.

Figure 2:
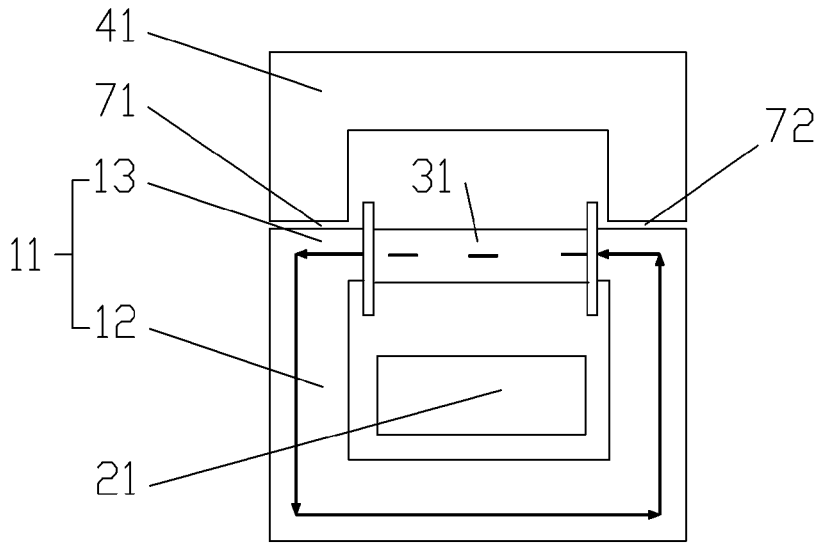
FIG. 2 to FIG. 4 are schematic diagrams of the working principle of the first embodiment of the current transformer of the present invention for supplying power to electronic controller.
Figure 3:
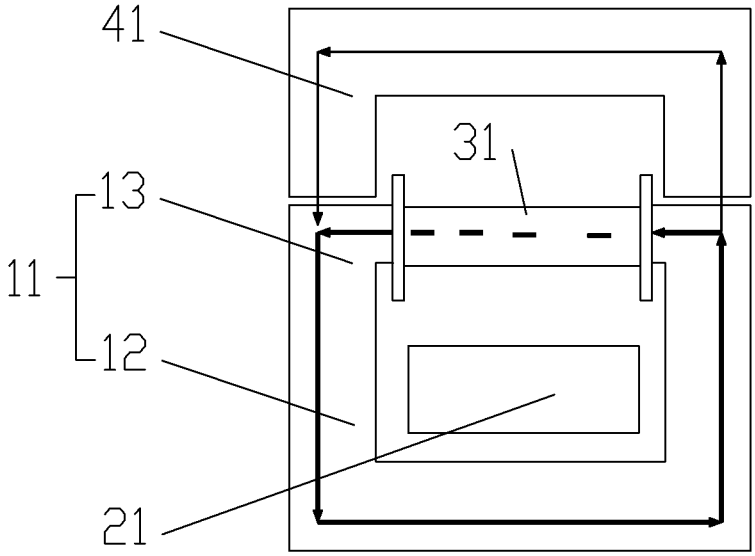
Figure 4:
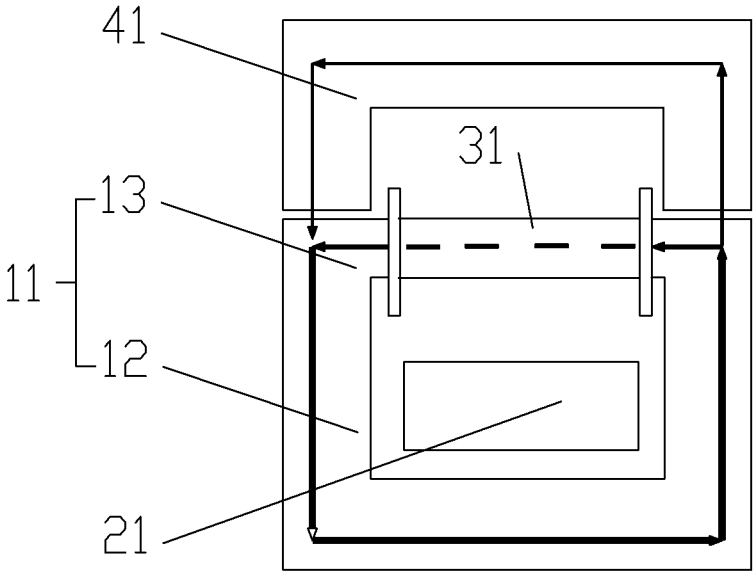

As shown in FIG. 1 to FIG. 4, the second core magnetic circuit 41 is a well-punched short U-shaped core having a magnetic conductivity different from that of the first core magnetic circuit, the second core magnetic circuit 41 is located on one side of the 'linear' silicon steel of the first core magnetic circuit 11, the secondary winding 31 for power supply is installed on the second core magnetic circuit 41 near the first core magnetic circuit 11, the two ends of an opening of the second core magnetic circuit 41 are located at the two sides of the secondary winding 31 for power supply, and two gaps are maintained between the U-shaped second core magnetic circuit 41 and the first core magnetic circuit 11, the two fixed air gaps 71 and 72 are respectively located at the two sides of the secondary winding 31 for power supply, more precisely, respectively located at the two intersections of the linear core 13 and the U-shaped core 12 of the first core magnetic circuit 11, the two ends of the second core magnetic circuit 41 are coupled with the first core magnetic circuit 11 through the two fixed air gaps 71 and 72 in such a manner that the primary current flowing through the primary core-extending conductor 21 causes the main magnetic flux inside the U-shaped core 12 to flow based upon the principle as shown in FIG. 2 to FIG. 4. When the current flowing through the primary conductor 21 has a low value, the magnetic flux mainly passes by the first core magnetic circuit on which a secondary winding for power supply is wound. In the case of high current, magnetic induction is enhanced, and through the two air gaps, most of the magnetic flux passes by the auxiliary magnetic circuit composed of the second core magnetic circuit. The current transformer of the present invention restricts supply of the rest power to the electronic circuit of controller and consumption of the rest power on the transformer by means of a nonlinear current characteristic curve.

The coupling described above means no contact between the first core magnetic circuit 11 and the second core magnetic circuit 41, or separation from each other through the fixed air gaps 71 and 72, and in order to restrict the output of the secondary winding 31 for power supply as required, a conditioned change relationship of air gap magnetic circuit exists between them. Specifically, in the case of small main magnetic flux, the magnetic flux flowing from the first core magnetic circuit 11 to the second core magnetic circuit 41 is so small that it is totally ignorable, and a part of the main magnetic flux flows obviously from the first core magnetic circuit 11 to a magnetic parallel-connection path formed by the second core magnetic circuit 41 only in the case of larger main magnetic flux. The area of the cross section of the linear core 13 of the first core magnetic circuit 11 of the present invention is less than that of the cross section of the U-shaped core 12, so that magnetic flux density in the linear core 13 is higher than that in the U-shaped core 12, as a result, the linear core 13 is magnetically saturated earlier than the U-shaped core 12 when the main magnetic flux reaches a particular value. It may be deduced from the theory of electromagnetics that: the main magnetic flux flowing inside the U-shaped core 12 is associated with the primary current flowing inside the primary core-extending conductor 21, and the secondary current output by the secondary winding 31 for power supply is associated with the magnetic flux flowing in the linear core 13. The ratio of the primary current to the secondary current is a fixed value when both the linear core 13 and the U-shaped core 12 are at the stage of non-magnetic saturation; however, the ratio of the primary current to the secondary current is not a fixed value when the linear core 13 is under the state of magnetic saturation but the U-shaped core is not, specifically, increase of the primary current does not lead to increase of the magnetic flux of the linear core 13 that has been magnetically saturated, therefore, the secondary current induced inside the secondary winding 31 for power supply is not increased therewith. Therefore, the design that the area of the cross section of the linear core 13 is less than that of the cross section of the U-shaped core 12 results in the fact that, the linear core 13 is magnetically saturated earlier than the U-shaped core 12, and the magnetic flux after the linear core 13 is magnetically saturated is no longer increased due to increase of the primary current, that is, the secondary current is no longer increased due to increase of the primary current, so that stable secondary current is kept. Since there is a quite small magnetic conductivity of the fixed air gaps 71 and 72 and there is a quite large magnetic conductivity of the first core magnetic circuit 11 and the second core magnetic circuit 41, the main magnetic flux inside the first core magnetic circuit 11 does not cross over the fixed air gaps 71 and 72 to enter the second core magnetic circuit 41 when the main magnetic flux does not exceed a setting value, and this setting value is dependent upon the thicknesses of the fixed air gaps 71 and 72. The thicknesses of the fixed air gaps (71, 72) are adjusted according to different requirements of products, thus ideal setting values can be acquired. By combining the technical feature of the fixed air gaps 71 and 72 and the technical feature that the area of the cross section of the linear core 13 is less than that of the cross section of the U-shaped core 12, the current transformer of the present invention has the effect of three-stage stabilization for secondary current as below: shunting of the second core magnetic circuit 41 for magnetic flux, magnetic saturation stabilization of the linear core 13 for secondary current, and magnetic saturation stabilization of the U-shaped core 12 for main magnetic flux. However, the current transformer in the prior art only has the effect of two-stage stabilization for secondary current at most: shunting of the second magnetic circuit (or the auxiliary magnetic circuit) for main magnetic flux and saturation stabilization of the first magnetic circuit (or the main magnetic circuit) for main magnetic flux. The following prominent effects can be generated owing to the function of three-stage stabilization for secondary current in the present invention: the starting current value is reduced, that is, output of the secondary current can meet the demand on reliable work of the controller in the case of a relatively small primary current (e.g. 0.2 In); ideal stable output of the secondary current can be acquired even within a wide normal range of the primary current (e.g. 0.2 In to In); and in the event that the primary current exceeds the rated current, normal work of the controller can be maintained and the transformer and the controller can be prevented from damage. There are two major differences based on a comparison between the function of three-stage stabilization for secondary current generated by the above technical feature of the present invention and the function of two-stage stabilization for secondary current in the prior art: the transformer of the present invention in which the first core magnetic circuit is designed ensures that: larger output from the secondary winding for power supply, which can meet the demand on reliable work of the controller, can be acquired in the case of a smaller primary loop current (e.g. 0.2 In), but this is impossible in the prior art; the transformer of the present invention can acquire ideal stable output of the secondary current even within a wide normal range of the primary current (e.g. 0.2 In to In), but this is impossible in the prior art, instead, it can ensure ideal stable output of the secondary current only within a narrow normal range of the primary current (e.g. 0.4 In to 1 In).

It can be seen from the description above that, 2 fixed air gaps 71 and 72 in the embodiment 1 as shown in FIG. 1 are respectively located at the intersections of the linear core 13 and the U-shaped core 12, and this is a preferred scheme with the advantages below: the main magnetic flux of the U-shaped core 12 can be directly shunted to the second core magnetic circuit 41 and no passage of the linear core 13 is present in this shunting, so the magnetic flux shunted is not restricted by magnetic saturation of the linear core 13, on the contrary, the more the linear core 13 tends to magnetic saturation, the more the magnetic flux shunted by the second core magnetic circuit 41 is. Undoubtedly, the fixed air gaps 71 and 72 will affect the effect of magnetic flux shunting of the second core magnetic circuit 41 if disposed away from the intersections, no matter whether they are disposed at one side of the linear core 13 or at one side of the U-shaped core 12.

Figure 5:
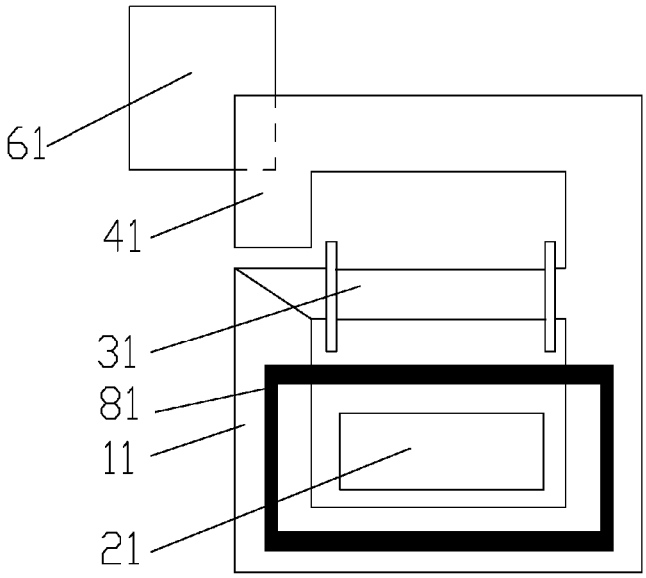
FIG. 5 is a structural schematic diagram of the second embodiment of the current transformer of the present invention for supplying power to electronic controller.

FIG. 5 is a structural schematic diagram of the second embodiment of the current transformer of the present invention for supplying power to electronic controller, and shows a transformation mode between main magnetic circuit and auxiliary magnetic circuit in the first embodiment. As shown in FIG. 5 and FIG. 1, what differs the second embodiment from the first embodiment is that, a fixed air gap is not used in this embodiment, so only one fixed air gap 71 is included, in additions, one end of the main magnetic circuit and one end of the auxiliary magnetic circuit are continuous, thus leading to different silicon steel sheet punching ways for core. As shown in FIG. 5, a supply current transformer for an electronic controller comprises a first core magnetic circuit 11, which is in a shape of closed loop and formed by connecting a U-shaped core 12 and a linear core 13, a U-shaped second core magnetic circuit 41 and a secondary winding 31 for power supply, a primary core-extending conductor 21 extends through the closed loop of the first core magnetic circuit 11, the secondary winding 31 for power supply is wound on the linear core 13. The area of the cross section of the linear core 13 is less than the area of the cross section of the U-shaped core 12, so that the linear core 13 is magnetically saturated earlier than the U-shaped core 12. One end of the second core magnetic circuit 41 is connected in parallel with the intersection of the linear core 13 and the U-shaped core 12 at one side of the secondary winding 31 for power supply, the other end of the second core magnetic circuit 41 is an open end that is coupled, through the fixed air gap 71, to the intersection of the linear core 13 and the U-shaped core 12 at the other side of the secondary winding 31 for power supply. The parallel connection described herein means that one end of the second core magnetic circuit 41, one end of the linear core 13 and one end of the U-shaped core 12 are all fixedly connected, and such a connection can realize normal flowing of magnetic flux among the second core magnetic circuit 41, the linear core 13 and the U-shaped core 12. The terms related to the second embodiment above are interchangeable with the terms in the first embodiment above, so further repeated description is not given herein to the terms of the second embodiment that are the same as those in the first embodiment. The fixed air gaps 71 and 72 in the first embodiment are formed in the process of assembling the first core magnetic circuit 11 and the second core magnetic circuit 41, whereas the fixed air gap 71 in the second embodiment is formed in the process of fixedly connecting the first core magnetic circuit 11 with the second core magnetic circuit 41, and this difference could result in different production processes for the second embodiment and the first embodiment in the present invention. There are two fixed air gaps between the two magnetic circuits in the first embodiment, however, there is only one fixed air gap in the second embodiment, so this difference could somewhat result in different output curves of the secondary current and further result in selection for different models of products, in this way, the size of the air gap in this embodiment can be guaranteed more conveniently, and the processing and assembling technologies can be better controlled.

The working principle of the current transformer of the present invention will be further described below with reference to FIG. 2 to FIG. 4. For ease of description, the starting current (the minimal primary current capable of meeting the demand on reliable work of the controller) is defined as $I_0$, the corresponding primary current when the linear core 13 is just magnetically saturated is defined as $I_1$, the corresponding primary current when the U-shaped core 12 is just magnetically saturated is defined as $I_2$, the rated primary current is $I_n$, and the primary current under an actual state is defined as I. FIG. 2 shows the situation of magnetic flux distribution when the primary current I of the transformer is within a small current region, and in this case, the second core magnetic circuit 41 is substantially free from shunting for magnetic flux, the main magnetic flux flows substantially inside the linear core 13, the primary current I within the small current region is at least more than $I_0$ in order to ensure that the secondary current can reach the extent as fast as possibly that meets the demand on reliable work of the controller, besides, the primary current I within the small current region is not allowed to exceed $I_1$, this is because smaller distance between I and $I_1$ could result in stronger tendency of the second core magnetic circuit 41 to shunting for magnetic flux. The starting point of the second core magnetic circuit 41 for prominent shunting for magnetic flux can be set by setting ideal thicknesses of the fixed air gaps 71 and 72, and the primary current $I_A$ to which this starting point is corresponding shall satisfy the condition below: $I_0<I_A\leq I_1$. It is thus apparent that, the function of first-stage stabilization for secondary current generated by shunting of the second core magnetic circuit 41 for magnetic flux is implemented by setting the condition of $I_A<I_1$. And on the basis of experiment results, an ideal $I_A$ can be acquired when the two fixed air gaps 71 and 72 are respectively set within a range from 0.1 mm to 2 mm. FIG. 3 shows the situation of magnetic flux distribution when the primary current I is within a normal-state load current region, and in this case, magnetic flux is shunted by the second core magnetic circuit 41, the main magnetic flux in the U-shaped core 12 flows not only inside the linear core 13, but also inside the second core magnetic circuit 41. The starting point $I_1$ at which the linear core 13 is just magnetically saturated can be set by reasonably setting the ratio of the area of the cross section of the linear core 13 to the area of the cross section of the U-shaped core 12, and setting for the ideal $I_1$ shall satisfy the two conditions below: $I_1>I_A$, and $0.8\ In\leq I_1\leq 1{,}2\ In$. When $I_1$ is much less than the rated current In, excessive shunting of the second core magnetic circuit 41 for magnetic flux occurs under a normal load, and further, there is too much energy consumption in the transformer; on the contrary, when $I_1$ is much more than the rated current In, the function for second-stage stabilization for secondary current provided by magnetic saturation of the linear core 13 is delayed and weakened. The applicant has drawn a conclusion from experiments that: when $I_1$ is set to be 0.8 to 1.2 times of the rated current In of the controller, namely, $I_1$ is set to be close to the rated current In, an ideal effect can be acquired. In addition, another conclusion is drawn from experiments that: an ideal $I_1$ can be acquired when the area of the cross section of the U-shaped core 12 is 1.2 to 3 times of that of the cross section of the linear core 13. Ideal stable output of the secondary current can be realized in the case of a larger primary current (even in the case that the primary current exceeds the rated current) by means of setting and matching for the parameters above. As shown in FIG. 4, the U-shaped core 12 is magnetically saturated and most of the magnetic flux is shunted by the second core magnetic circuit 41 in case that the primary current is too large (an overload current or a short circuit current occurs), therefore, no matter how large the primary current is, this magnetic saturation leads to no increase of the main magnetic flux, both the magnetic flux inside the linear core 13 and the magnetic flux inside the second core magnetic circuit 41 have a tendency to stabilization, and such stabilization not only guarantees stable output of the secondary current, but also protects the current transformer and the controller from damage; and the transformer plays a role of third-stage stabilization for secondary current in stabilization for main magnetic flux.

As shown in FIG. 1, the two fixed air gaps 71 and 72 in the first embodiment have equal thickness, and this is a preferred scheme having the advantage of convenience in matching design for parameters. The two fixed air gaps of the current transformer of the present invention, however, may be not equal in thickness, and this unequal thickness belongs to an alternative scheme of the first embodiment. If the fixed air gaps 71 and 72 are filled with solid non-ferromagnetic matters (e.g. plastic sheet), the effect can be acquired that is identical to the effect of no filled solid non-ferromagnetic matters, but the advantage resulted from filling the solid non-ferromagnetic matters is that higher assembly precision is obtained for the thickness of the fixed air gaps 71 and 72, and simultaneously, excellent stability can be maintained subsequent to assembly.

As shown in FIG. 1, the second core magnetic circuit 41 and the first core magnetic circuit 11 are disposed in a coplanar manner, this coplanar disposition means that the first core magnetic circuit 11 and the second core magnetic circuit 41 are in the same plane and the magnetic flux flowing in the first core magnetic circuit 11 and the magnetic flux flowing in the second core magnetic circuit 41 are in the same plane, in this way, the magnetic fluxes flowing between the first core magnetic circuit 11 and the second core magnetic circuit 41 may be maintained in the original direction, that is, the magnetic flux of the first core magnetic circuit 11 is not changed in direction in the process of flowing into the second core magnetic circuit 41 through the fixed air gaps, and the magnetic flux of the second core magnetic circuit 41 is not changed in direction in the process of flowing into the first core magnetic circuit 11 through the fixed air gaps. Also, it is certainly possible to change the above preferred structure scheme of coplanar disposition in the entire design of transformer.

To guarantee that ideal shunting for magnetic flux can be performed by the second core magnetic flux 41 in the case of too large current, the area of the cross section of the second core magnetic flux 41 cannot be too small, and to guarantee that the second core magnetic flux 41 is not always earlier than the U-shaped core 12 in magnetic saturation, ideal matching is to realize equality between the area of the cross section of the second core magnetic flux 41 and the area of the cross section of the U-shaped core 12. Therefore, in the embodiment as shown in FIG. 1, the area of the cross section of the second core magnetic circuit 41 should be at least larger than or equal to the area of the cross section of the linear core magnetic circuit 13.

It can be seen from electromagnetic magnetic circuit theorem that, longer U-shaped core 12 brings about larger magnetic resistance, which is more unfavorable for lowering the starting current $I_0$. In the present invention, in order to obtain smaller magnetic resistance of the first core magnetic circuit to further guarantee larger output from the secondary winding for power supply in the case of smaller primary loop current, the spacing between the first core magnetic circuit 11 and the primary core-extending busbar 21 is designed in a compact way based upon the principle of the shortest length L of the first core magnetic circuit. The ideal matching in designing the first core magnetic circuit is that the centerline length of the U-shaped core 12 is 1.5 to 4 times of that of the linear core 13, so that excellent electrical isolation is achieved between the first core magnetic circuit and the primary conductor surrounded by the first core magnetic circuit, and simultaneously, the first core magnetic circuit 11 surrounding the primary conductor 21 has the shortest magnetic circuit length. Preferably, the fixed spacing between the primary core-extending conductor 21 and the first core magnetic circuit 11 encapsulated inside the casing is set as 2-3 mm. Shorter length of the linear core 13 means better effect that facilitates miniature design of product, but its length cannot be too small because of restriction from the secondary winding 31 for power supply. Similarly, shorter length of the U-shaped core 12 means better effect, however, too small length is unacceptable because of length restriction from the linear core 13. When the centerline length of the U-shaped core 12 is 1.5 to 4 times of that of the linear core 13, the length of the first core magnetic circuit can meet the optimization requirement on shorter length on the premise of taking various restrictions into account. Meanwhile in the present invention, the sectional dimension of the cores is preferred, the magnetic circuit is independent, closed and free from air gaps, the core is made of a material that has high initial magnetic conductivity, as a result, a particular working magnetic flux $\phi$ can be generated only by a smaller excitation current Im, so as to acquire relatively large output of the secondary current.

Figure 6:
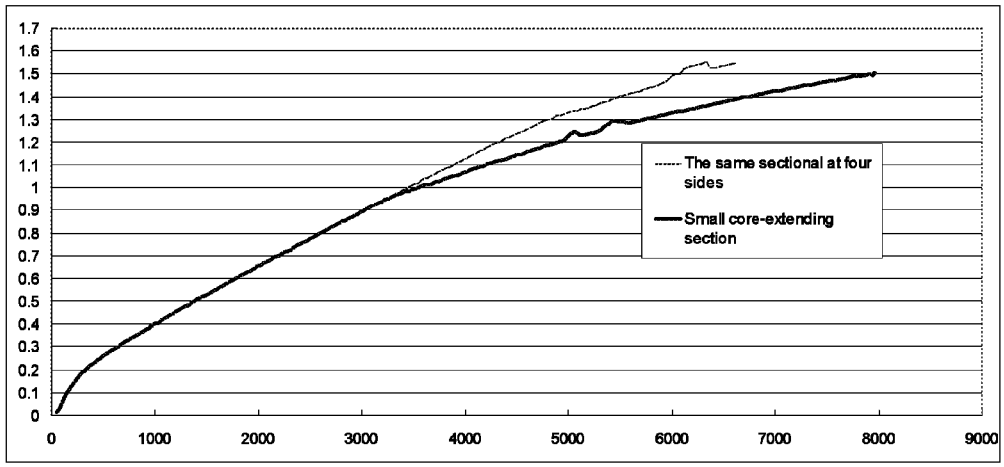
FIG. 6 is a curve diagram showing the experiment effect of a comparison between the current transformer with unequal sections and the current transformer with equal section, in which the curve located above represents the effect of the current transformer with equally-sectioned first core magnetic circuit, and the curve located below is worked out on condition that the area of the cross section of the linear core 13 is slightly less than that of the cross section of the U-shaped core 12, and represents the effect of unequally-sectioned first core magnetic circuit.

FIG. 6 is a curve diagram showing the effect of a comparison between the current transformer for electronic controller with unequal sections and the current transformer for electronic controller with equal section. In the drawing, horizontal coordinate represents the input amount of the primary current from the primary core-extending busbar of the transformer, and longitudinal coordinate represents the output amount of the secondary current from the transformer using a controller as load. The curve 1 is obtained on condition that the area of the cross section of the linear core 13 is equal to the area of the cross section of the U-shaped core 12, and represents the effect of the current transformer with equally-sectional first core magnetic circuit. The curve 2 is obtained on condition that the area of the cross section of the linear core 13 is less than the area of the cross section of the U-shaped core 12, and represents the effect of unequally-sectional first core magnetic circuit. It can be seen from FIG. 6 and the data attached that, in the case of a smaller primary current the curve 1 and the curve 2 are substantially consistent, but when the primary current increases, the working magnetic flux $\phi$ increases as well, and the core 13 extending through the secondary winding for power supply has a smaller section than the core 12 at the rest three sides, so it has higher magnetic flux density B and is easier to be saturated. After the core 13 is saturated, more magnetic flux, due to worse magnetic conductivity, will flow through the second magnetic flux 41 which is connected in parallel with the core 13. Referring to FIG. 6, output under unequal sections is significantly lower than output under equal section after the primary current increases, and the curve 2 is much smoother than the curve 1, indicating that the technical feature that the area of the cross section of the linear core 13 is less than that of the cross section of the U-shaped core 12 has a prominent effect on inhibiting the rapid output increase of the secondary current, and the function of three-stage stabilization for secondary current is so excellent that ideal stable output of the secondary current can be achieved within a wider range of the primary current. In addition, this stable output facilitates parameter selection and regulation of the small primary current.

It shall be understood that, the embodiments above are merely for description of the present invention, not in a restrictive sense thereto, and any inventive creation without departing from the essential spirit scope of the present invention shall fall within the scope of the present invention.

The invention claimed is:

1. A current transformer for supplying power to electronic controller, comprising:

a first core magnetic circuit and a second core magnetic circuit independent of each other, wherein the first core magnetic circuit is a closed loop formed by connecting a U-shaped core and a linear core, and a primary core-extending conductor extends through the closed loop of the first core magnetic circuit, and a secondary winding for power supply is wound on the linear core of the first core magnetic circuit; and the second core magnetic circuit having an opening shape is disposed in parallel to the linear core of the first core magnetic circuit, and open ends of the second core magnetic circuit are coupled to the first core magnetic circuit through air gaps, wherein, an area of the cross section of the linear core is less than an area of the cross section of the U-shaped core, so that the linear core can be magnetically saturated earlier than the U-shaped core, wherein a centerline length of the U-shaped core is 1.5 to 4 times of a centerline length of the linear core;

said U-shaped core and the linear core of the first core magnetic circuit have a spacing of 2-3 mm from the primary core-extending conductor surrounded by the first core magnetic circuit, so that electrical isolation is formed between the first core magnetic circuit and the primary core-extending conductor surrounded by the first core magnetic circuit, and simultaneously, the first core magnetic circuit surrounding the primary conductor has a shortest length.

2. The current transformer for supplying power to electronic controller according to claim 1, wherein said area of the cross section of the U-shaped core is 1.2 to 3 times of the area of the cross section of the linear core.

3. The current transformer for supplying power to electronic controller according to claim 1, wherein when the linear core is just magnetically saturated, a corresponding primary current $I_1$ is 0.8 to 1.2 times a rated current In of a primary main circuit.

4. The current transformer for supplying power to electronic controller according to claim 1, wherein said second core magnetic circuit and the first core magnetic circuit are disposed in a coplanar manner, so that magnetic flux flowing between the first core magnetic circuit and the second core magnetic circuit is maintained in an original direction.

5. The current transformer for supplying power to electronic controller according to claim 1, wherein the two air gaps between the open ends of the second core magnetic circuit and the first core magnetic circuit are fixed air gaps, which are respectively located at two intersections of the linear core and the U-shaped core and also located at two sides of the secondary winding for power supply.

6. The current transformer for supplying power to electronic controller according to claim 5, wherein said two fixed air gaps have a thickness from 0.1 mm to 2 mm.

7. The current transformer for supplying power to electronic controller according to claim 5, wherein said two fixed air gaps are equivalent in thickness and respectively filled with solid non-ferromagnetic matters.

8. The current transformer for supplying power to electronic controller according to claim 1, wherein said area of the cross section of the core of the second core magnetic circuit is equal to that of the cross section of the U-shaped core of the first core magnetic circuit.

9. A current transformer for supplying power to electronic controller, comprising a first core magnetic circuit and a second core magnetic circuit, wherein the first core magnetic circuit is a closed loop formed by connecting a U-shaped core and a linear core, and a primary core-extending conductor extends through the closed loop, and a secondary winding for power supply is wound on the linear core; the second core magnetic circuit having an opening shape is disposed in parallel to the linear core, the second core magnetic circuit having an open end, wherein an area of the cross section of the linear core is less than an area of the cross section of the U-shaped core, so that the linear core can be magnetically saturated earlier than the U-shaped core;

a centerline length of the U-shaped core is 1.5 to 4 times of a centerline length of the linear core;

said open end of the second core magnetic circuit is coupled, through a fixed air gap, to an intersection of the linear core and the U-shaped core located at one side of the secondary winding for power supply, and a second end of the second core magnetic circuit is fixedly connected to an intersection of the linear core and one end of the U-shaped core located at another side of the secondary winding for power supply.

* * * * *